US006871658B2

(12) United States Patent
Gjestvang

(10) Patent No.: US 6,871,658 B2
(45) Date of Patent: Mar. 29, 2005

(54) TRANSIT CONCRETE MIXER DRUM WASHOUT SYSTEM

(76) Inventor: Robert Gjestvang, 2590 W. 80th Ave., Denver, CO (US) 80221

( * ) Notice: Subject to any disclaimer, the term of this patent is extended or adjusted under 35 U.S.C. 154(b) by 73 days.

(21) Appl. No.: 09/965,225

(22) Filed: Sep. 27, 2001

(65) Prior Publication Data

US 2002/0036003 A1 Mar. 28, 2002

Related U.S. Application Data

(60) Provisional application No. 60/236,217, filed on Sep. 28, 2000.

(51) Int. Cl.[7] ..... B08B 9/00

(52) U.S. Cl. ..... 134/167 R; 134/45; 134/123; 134/166 R; 134/168 R; 134/169 R; 134/171; 134/56 R; 239/525; 239/530; 239/722; 239/743; 239/752

(58) Field of Search ..... 134/167 R, 166 R, 134/168 R, 169 R, 171, 56 R, 45, 123; 239/525, 722, 743, 752, 530

(56) References Cited

U.S. PATENT DOCUMENTS

| | | | | |
|---|---|---|---|---|
| 2,997,244 A | | 8/1961 | Demaison | |
| 3,104,672 A | | 9/1963 | Holdren | |
| 3,599,871 A | * | 8/1971 | Ruppel et al. | 239/227 |
| 3,645,452 A | * | 2/1972 | Stoeckel et al. | 239/227 |
| 3,689,318 A | | 9/1972 | Phillips | |
| 3,741,808 A | * | 6/1973 | Stalker | 134/58 R |
| 3,897,263 A | | 7/1975 | Davis et al. | |
| 3,961,983 A | | 6/1976 | Crandall et al. | |
| 4,106,516 A | | 8/1978 | Wiegand | |
| 5,244,498 A | | 9/1993 | Steinke | |
| 5,419,496 A | | 5/1995 | Novak, Jr. | |
| 5,507,875 A | | 4/1996 | Hailey | |
| 6,192,905 B1 | * | 2/2001 | Mincy et al. | 134/167 R |
| 6,321,754 B1 | * | 11/2001 | Manabe et al. | 134/113 |

* cited by examiner

*Primary Examiner*—M. Kornakov
(74) *Attorney, Agent, or Firm*—Emery L. Tracy

(57) ABSTRACT

A washout system for cleaning concrete and other materials from the inside surface of a concrete mixer drum with a fluid is provided. The concrete mixer drum mounted to a concrete truck or the like with the fluid stored in a predetermined fluid source with the fluid source activatable to release fluid. The washout system comprises a telescoping pipe assembly extendible into the mixer drum with the telescoping pipe assembly having a first end and a second end and the first end fluidly connected to the fluid source. A spray bar is fluidly connected to the second end of the telescoping pipe assembly and a plurality of nozzles positioned circumferentially about and longitudinally along the spray bar wherein upon activation of the fluid source, thereby introducing fluid into the telescoping pipe assembly, the second end of the telescoping pipe assembly extends into the mixer drum.

8 Claims, 1 Drawing Sheet

TRANSIT CONCRETE MIXER DRUM WASHOUT SYSTEM

The present application is a continuation of pending provisional patent application Ser. No. 60/236,217, filed on Sep. 28, 2000, entitled "Transit Concrete Mixer Drum Washout System".

BACKGROUND OF THE INVENTION

1. Field of the Invention

This invention relates generally to a washout system for a transit concrete mixer drum and, more particularly, it relates to a washout system for a transit concrete mixer which is extendible into the mixer drum for delivering pressurized water into the interior of the mixer drum.

2. Description of the Prior Art

Transit concrete mixer drums typically consist of a large mixer drum with internal fins arranged in a corkscrew pattern. The mixer drum is mounted horizontally and rotated about a center axis. As the mixer drum turns, the fins force the concrete into or out of the drum depending on the direction of rotation.

Unfortunately, current concrete mixer drum design does not allow complete removal of the concrete. In fact, when the mixer drum is loaded with fresh concrete and then unloaded, a small amount of concrete remains inside the mixer drum adjacent the fins. In an attempt to remove the remaining concrete, the concrete truck driver or operator will then fill the mixer drum with water in an attempt to wash the remaining concrete from the mixer drum. However, since concrete trucks only carry a maximum of one hundred and twenty-five (125) gallons of water which must be used to water down the load before concrete unloading, the remaining amount of water is not sufficient to clean the mixer drum, especially on the side of the fins facing toward the front of the concrete truck.

Another alternative to remove the concrete prior to hardening within the mixer drum is to load a large amount of water into the mixer drum upon the concrete truck returning to the operation site. Unfortunately, the water travels directly to the front of the mixer drum and does not wash the back side of the fins. The operator typically can not reach far enough into the mixer drum to reach the back side of the fins.

The concrete remaining in the mixer drum which is not washed out, the concrete will harden inside the mixer drum. Over time, layers of concrete build up until large amounts of dried, hardened concrete is present inside the mixer drum; reducing the mixer drum volume and mixing with the fresh concrete. The hardened concrete must now be removed by mechanical or chemical means. Neither of the mechanical means nor chemical means are an attractive method for the concrete truck operator due to high costs and environmental hazards. For instance, mechanical means typically requires a person to physically enter the drum with a jackhammer to physically remove the hardened concrete. Chemical means, on the other hand, typically requires dangerous chemical which can contaminate the environment or require special handling and safety procedures.

Accordingly, there exists a need for a transit concrete mixer drum washout system which effectively removes concrete from the inside of a mixer drum prior to the concrete hardening therein. Additionally, a need exists for a transit concrete mixer drum washout system which does not require either expensive mechanical removal of hardened concrete or dangerous chemicals harmful to the environment. Furthermore, there exists a need for a transit concrete mixer drum washout system which is extendible into the mixer drum to inject pressurized water to all areas thereby removing the concrete therein prior to hardening.

SUMMARY

The present invention is a washout system for cleaning concrete and other materials from the inside surface of a concrete mixer drum with a fluid. The concrete mixer drum mounted to a concrete truck or the like with the fluid stored in a predetermined fluid source with the fluid source activatable to release fluid. The washout system comprises a telescoping pipe assembly extendible into the mixer drum with the telescoping pipe assembly having a first end and a second end and the first end fluidly connected to the fluid source. A spray bar is fluidly connected to the second end of the telescoping pipe assembly and a plurality of nozzles positioned circumferentially about and longitudinally along the spray bar wherein upon activation of the fluid source, thereby introducing fluid into the telescoping pipe assembly, the second end of the telescoping pipe assembly extends into the mixer drum.

The present invention additionally includes a method for cleaning concrete and other materials from the inside surface of a concrete mixer drum with a fluid. The method comprise providing a telescoping pipe assembly, providing a spray bar, forming a plurality of nozzles along the spray bar, connecting the spray bar to the telescoping pipe assembly, introducing fluid into the telescoping pipe assembly, and extending at least a portion of the telescoping pipe assembly into the mixer drum.

The present invention further includes an assembly for cleaning concrete and other materials from the inside surface of a concrete mixer drum with a fluid. The assembly comprises telescoping means extendible into the mixer drum and spray means connected to the telescoping means.

DETAILED DESCRIPTION OF THE PREFERRED EMBODIMENTS

Figure 1:
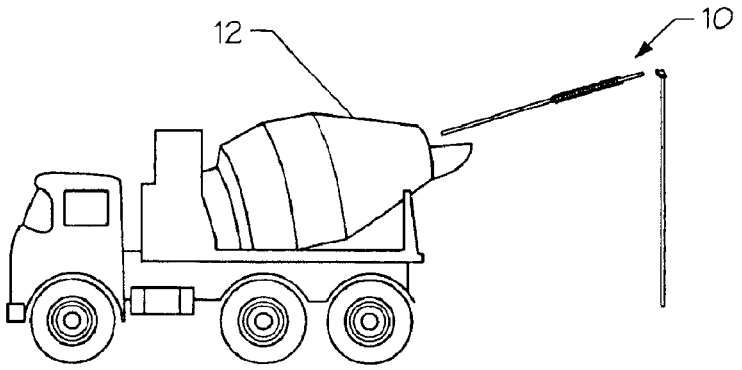
FIG. 1 is a sectional side view illustrating a transit concrete mixer drum washout system, constructed in accordance with the present invention, with the washout system extended into the mixer drum.
Figure 2:
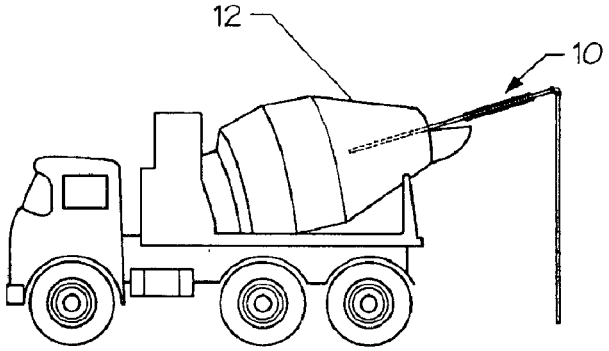
FIG. 2 is an elevational side view illustrating the transit concrete mixer drum washout system, constructed in accordance with the present invention, with the washout system in the starting position.
Figure 3:
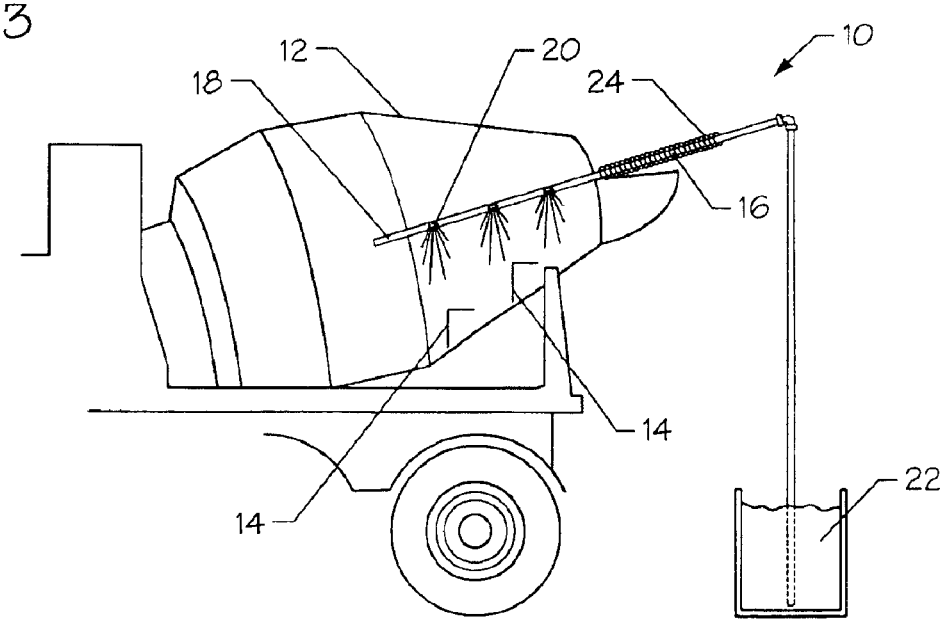
FIG. 3 is an elevation side view illustrating the transit concrete mixer drum washout system, constructed in accordance with the present invention, with the washout system in the activated position.

As illustrated in FIGS. 1–3, the present invention is a washout system, indicated generally at 10, for washing concrete or the like from a transit concrete mixer drum 12 or other type of vehicle with difficult accessibility. As discussed above, transit concrete mixer drums 12 typically consist of a large mixer drum 12 with internal mixing fins 14 arranged in a substantial corkscrew pattern. The mixer drum 12 is typically mounted substantially horizontally upon a concrete truck and rotated about a center axis. Depending on the desired direction of rotation, as the mixer drum 12 rotates about the center axis, the mixing fins 14 actually force the concrete deeper into the mixer drum 12 to insure complete mixing of the concrete or out of the mixer drum 12 for deposit of the concrete in a desired location.

The washout system 10 of the present invention includes a telescoping pipe 16 having a plurality of pipe sections with each pipe section being receivable within the adjacent pipe section such that in the starting position, the washout system 10 is completely retracted. At the end of the telescoping pipe 16, a spray bar 18 is fluidly connected thereto. The spray bar 18 preferably has a plurality of nozzles 20 positioned circumferentially about and longitudinally along the spray bar 18 to direct water in all or substantially all directions within the mixer drum 12, including to hard-to-reach areas behind the mixing fins 14 where concrete tends to collect thereby insuring complete washout of the mixer drum 12.

The telescoping pipe 16 is connected to a water supply 22 and is extendible completely into the mixer drum 12 to reach the back side of all of the mixing fins 14. When pressurized water is applied to the telescoping pipe 16, the washout system 10 of the present invention is activated with the spray bar 18 automatically or manually extending completely into the mixer drum 12. The nozzles 20 of the spray bar 18 direct the pressurized water onto the inside surfaces of the mixer drum 12, including the back side of the mixing fins 14, not normally reachable through any other conventional mixer drum washing method.

The washout system 10 is connectable to a water supply 22, either from a standpipe at the operation site or the water supply stored on the concrete truck, if any remains after removal of the concrete at the desired location. Furthermore, non-toxic, environmentally friendly cleaning agents can be used, although not necessarily required, to assist in thoroughly cleaning the inside surfaces of the mixer drum 12, including the mixing fins 14.

As described above, preferably, the length of the telescoping pipe 16 is sufficient to reach the front of the farthest forward mixing fin 14 of the mixer drum 12 and wash the back side of all of the mixing fins 14 to inhibit any concrete building up on the back side of the fins 14 or elsewhere within the mixer drum 12. The nozzles 20 are preferably recessed relative to the spray bar 18 to inhibit any potential problems associated with retracting the spay bar 18 into the telescoping pipe 16 once the mixer drum 12 washout is complete and deactivated. Furthermore, the angle of the telescoping pipe 16 relative to the ground should be equivalent to the interior layout of the mixer drum 12 so that the telescoping pipe 16 does not become caught or broken off inside the mixer drum 12.

The spray bar 18 of the washout system 10 of the present invention is preferably includes an automatic return system 24 such as a weight and pulley or spring. The return system 24 allows the spray bar 18 to automatically retract into the telescoping pipe 16 once the water pressure to the telescoping pipe 16 is turned off or otherwise disconnected. The automatic return system 24 allows the spray bar 18 and the telescoping pipe 16 to return to the starting, stored position and not remain inside the mixer drum 12 when the concrete truck is in transit. It should be noted, however, that a manual return system 24 is also within the scope of the present invention.

It should be noted that the washout system 10 can be connected directly to the concrete truck or the standpipe. Therefore, the washout system 10 can be transported to a job location for immediate clean out.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A washout system for cleaning concrete and other materials from the inside surface of a concrete mixer drum with a fluid, the concrete mixer drum mounted to a concrete truck or the like, the fluid stored in a predetermined fluid source with the fluid source activatable to release fluid, the washout system comprises:

a telescoping pipe assembly extendible into the mixer drum, the telescoping pipe assembly having a first end and a second end, the first end fluidly connected to the fluid source;

a spray bar fluidly connected to the second end of the telescoping pipe assembly; and a plurality of nozzles positioned circumferentially about and longitudinally along the spray bar;

wherein upon introducing fluid into the telescoping pipe assembly, the second end of the telescoping pipe assembly automatically extends into the mixer drum;

wherein the telescoping pipe assembly has an automatic return system such that the spray bar automatically retracts into the telescoping pipe upon deactivation of the fluid source and the telescoping pipe assembly retracting from within the mixer drum.

2. The washout system of claim 1 wherein the telescoping pipe assembly has a plurality of pipe sections, each pipe section being receivable within an adjacent pipe section.

3. The washout system of claim 1 wherein the nozzles direct fluid in at least substantially all directions to the inside surface within the mixer drum.

4. The washout system of claim 1 wherein the nozzles are recessed.

5. The washout system of claim 1 wherein the fluid source is mounted to the concrete truck.

6. The washout system of claim 1 wherein the telescoping pipe assembly has an angle substantially equivalent to the interior layout of the mixer drum.

7. The washout system of claim 1 wherein the automatic return system is selected from the group consisting of a weight and pulley and a spring.

8. The washout system of claim 1 wherein the telescoping pipe assembly has a manual return system for manually retracting the spray bar and telescoping pipe assembly from within the mixer drum.

* * * * *